US005396944A

United States Patent [19]

Rossini

[11] Patent Number: 5,396,944

[45] Date of Patent: Mar. 14, 1995

[54] DEVICE FOR OPERATING A VENETIAN BLIND OR THE LIKE PLACED INSIDE AN INSULATING GLASS FRAME

[75] Inventor: Mauro Rossini, Este, Italy

[73] Assignee: Finvetro S.r.l., Este, Italy

[21] Appl. No.: 195,103

[22] Filed: Feb. 14, 1994

[30] Foreign Application Priority Data

Feb. 17, 1993 [IT] Italy ..... PD93U0014

[51] Int. Cl.[6] ..... A47H 1/00

[52] U.S. Cl. ..... 160/107; 160/170

[58] Field of Search ..... 160/107, 168.1 R, 168.1 P, 160/ 170, 171

[56] References Cited

U.S. PATENT DOCUMENTS 4,723,586 2/1988 Spangenberg ..... 160/107
4,768,576 9/1988 Anderson ..... 160/107
4,817,698 4/1989 Rossini et al. ..... 160/107

FOREIGN PATENT DOCUMENTS 0109382 5/1984 European Pat. Off. .
0245811 11/1987 European Pat. Off. .
9002677 6/1990 Germany .

*Primary Examiner*—Blair M. Johnson
*Attorney, Agent, or Firm*—Guido Modiano; Albert Josif; Daniel O'Byrne

[57] ABSTRACT

Motorized actuation device for a Venetian blind or the like placed inside an insulating glass frame including a first magnet, arranged inside the insulating glass frame and directly connected to the respective actuation system, and a second external magnet, the second magnet being associated with the translatory part of a kinematic system for converting the rotary motion into a translatory motion, and the kinematic system being connected to an actuation gearmotor.

12 Claims, 1 Drawing Sheet

DEVICE FOR OPERATING A VENETIAN BLIND OR THE LIKE PLACED INSIDE AN INSULATING GLASS FRAME

BACKGROUND OF THE INVENTION

The present invention relates to a motorized device for operating a Venetian blind or the like placed inside an insulating glass frame.

Venetian blinds or the like placed inside an insulating glass frame, with magnetic operating means, are already known.

In these known devices, the Venetian blind is accommodated in the airtight interspace formed between the two glass panes of the insulating glass frame and is operated, as regards the adjustment of the packing and/or tilt of its slats, by means of a magnetic coupling, through one of the glass panes, between a first internal magnet connected directly to respective actuation systems and a second external magnet.

The internal mechanical devices are made so that they are actuated by means of a straight? line movement of the magnets.

In domestic installations actuation is mostly manual.

In offices, hospitals, etc, and in all installations where manual actuation is awkward or difficult, motorized actuation devices that do not use a magnetic coupling have been devised.

These devices are currently placed entirely inside the insulating glass frame, but this is a drawback, since breakage of the likewise internal electric motor meant to operate them forces one to open the insulating glass frame for replacement.

This naturally causes inconveniences for the users as well as prohibitive times and costs.

SUMMARY OF THE INVENTION

A principal aim of the present invention is to provide a device for operating a Venetian blind placed inside an insulating glass frame that eliminates the drawback described above in known types.

A further aim of the present invention is to provide a motorized actuation device in which the part subject to possible breakdowns or malfunctions is outside the insulating glass frame and can therefore be replaced simply and rapidly.

Another important aim of the invention is to provide a motorized actuation device for Venetian blinds placed inside an insulating glass frame to be installed in offices, hospitals, etc., or anyway in places where manual actuation is difficult or awkward.

Another aim of the present invention is to provide a motorized actuation device having a Simple structure and a low cost.

With these aims in view, as well as others which will become apparent hereinafter, there is provided, according to the present invention, a motorized actuation device for a Venetian blind or the like placed inside an insulating glass frame, of the type comprising a first magnet, which is arranged inside the insulating glass frame and is directly connected to the respective actuation system, and a second external magnet, said second magnet being associated with the translatory part of a kinematic system for converting the rotary motion into a translatory motion.

Advantageously, said kinematic system is connected to an actuation gearmotor.

BRIEF DESCRIPTION OF THE DRAWINGS

Further characteristics and advantages of the device according to the present invention will become apparent from the following detailed description of a preferred embodiment thereof, illustrated by way of non-limitative example in the accompanying drawings, wherein.

DESCRIPTION OF THE PREFERRED EMBODIMENTS

Figure 1:
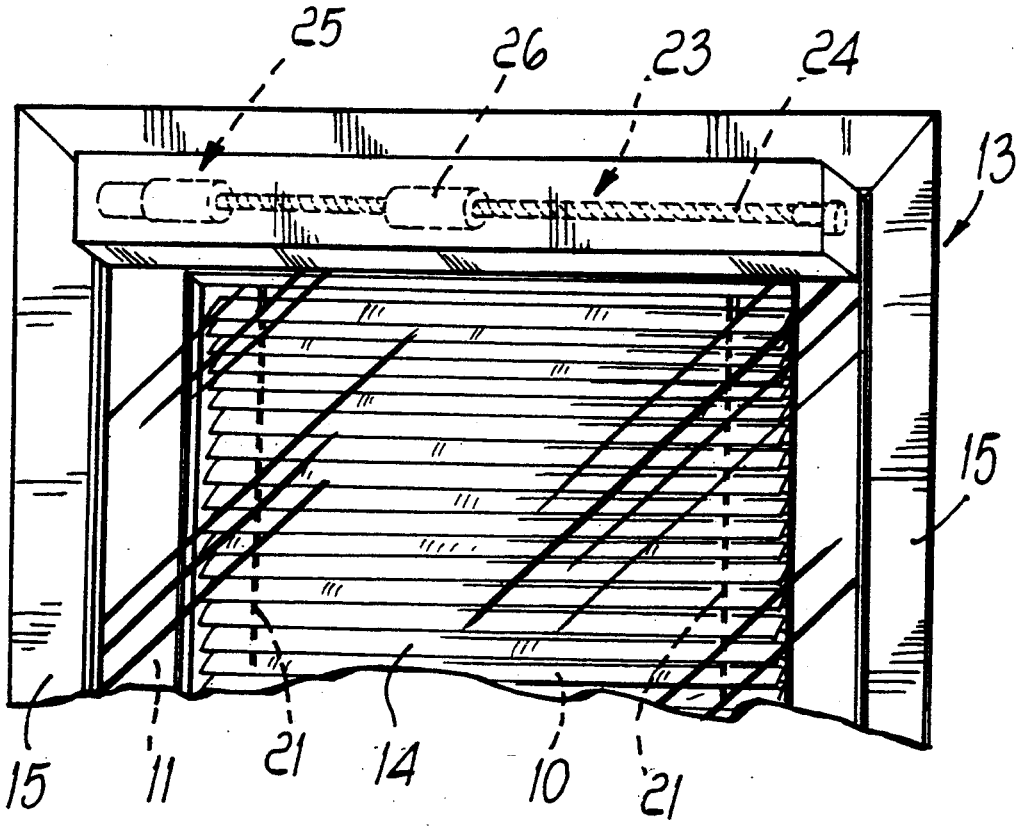
FIG. 1 is a perspective view of the upper part of an insulating glass frame containing a Venetian blind.
Figure 2:
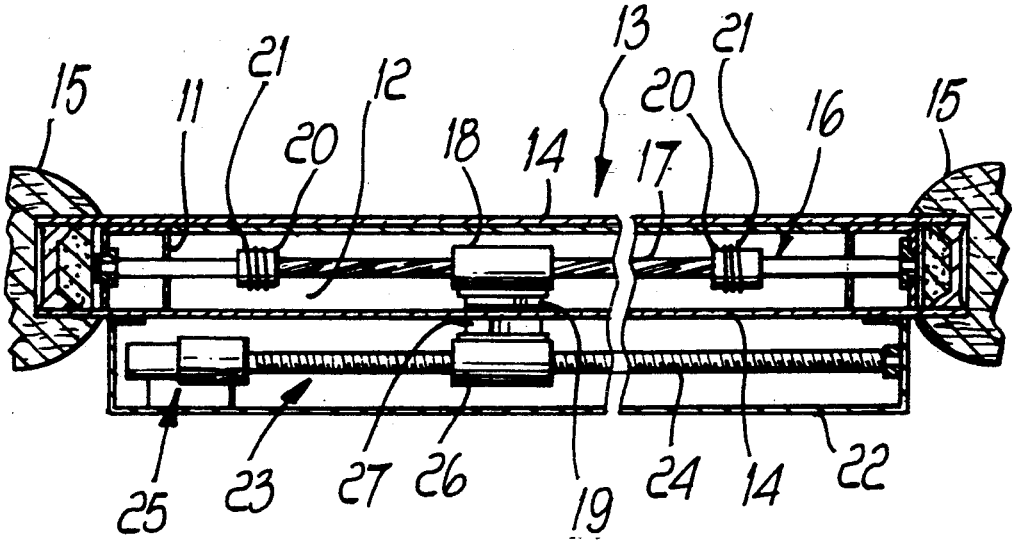
FIG. 2 is a sectional view, taken along a horizontal plane formed by the axes of the shafts related to the motorized actuation device according to the present invention.

With reference to the above figures, a Venetian blind is generally designated by the reference numeral 10 and comprises a plurality of slats connected to the upper side of a perimetric frame 11 which is conveniently constituted by a C-shaped profile having substantially the same thickness as the internal interspace 12 of the insulating glass frame 13 in which the Venetian blind 10 is inserted.

As is known, the insulating glass frame 13 is essentially constituted by a pair of glass panes 14 which are spaced apart by an aluminum frame 15 which is sealingly connected thereto in an airtight manner.

The Venetian blind 10 has means for adjusting the inclination of the slats which comprise a shaft 16 that is rotatably connected to the frame 11 and has a median portion 17 having a helical shape.

As can be seen in the figures, the shaft 16 is located inside the horizontal upper portion of the perimetric frame 11.

A bush 18 is connected to the median portion 17 of the shaft 16 and is internally shaped complementarily to the helical profile; a first magnet 19 is connected to said bush, rests internally on the corresponding glass pane 14 and is retained so that it slides on said pane.

Pulley-like supports 20 are also fixed to the shaft 16, and the cords 21 wind around them; said cords, with their vertical movement, cause the synchronized rotation of all the slats of the Venetian blind 10 about a longitudinal axis thereof.

A screw-and-nut kinematic system 23 is located on the outside of the insulating glass frame 13 in a box-like structure 22 which is fixed thereto by means of double-adhesive tape or other movable systems; the worm screw 24 is rigidly coupled to the output shaft of an electric gearmotor 25, and the nut 26 supports a second magnet 27 which is fixed to it, is coupled to said first magnet 19 through the glass pane 14, and is retained so that it slides on said pane.

In practice, by operating the gearmotor 25 the nut 26 is moved along the worm screw 24, and accordingly the magnets 27 and 19 move together, the bush 18 moves and the shaft 16 turns.

This entails the movement of the cords 21 and thus a change in the inclination of the slats of the blind 10.

Since the electric motor is outside the insulating glass frame 13, it can be easily replaced or repaired in case of breakdown or failure simply by disconnecting the box-like structure 22 from the frame 13.

It should also be noted that the kinematic system used for the movement for adjusting the inclination is also usable to adjust the packing of the blind or, if the blind is constituted by a shade, its rolling, although it is convenient to place a gearing-up unit, for example of the gear-based type, between a shaft corresponding to the shaft 16 described earlier and the shaft supporting the pulleys for winding the packing cords or for rolling up the shade.

In practice it has been observed that the intended aim and objects of the present invention have been achieved.

In practice, the materials employed, so long as they are compatible with the contingent use, as well as the dimensions, may be any according to the requirements.

I claim:

1. Motorized actuation device for a Venetian blind (10) placed inside an insulating glass frame (13), comprising a first magnet (19), arranged inside the insulating glass frame and directly connected to a respective actuation system (16,18,20,21) for manipulating the blind, and a second external magnet (27), said second magnet being associated with a translatory part (26) of a kinematic system (23) for converting rotary motion into a translatory motion, and wherein said kinematic system is a screw-and-nut kinematic system (23) in which a worm screw (24) is rigidly coupled to an output shaft of an electric gearmotor (25) and a nut (26) is mounted on said screw (24) and is thereby slidingly retained with respect to the insulating glass frame (13).

2. Device according to claim 1, wherein said kinematic system (23) is contained within a box-like structure (22) which is fixed to said insulating glass frame (13) in a removable manner.

3. Device according to claim 1, wherein said first magnet (19), slidingly coupled to said insulating glass frame, is externally fixed to a bush (18) that internally has a helical profile which is shaped complementarily to a helical profile (17) of a corresponding portion of an interior shaft (16) arranged inside said insulating glass frame (13) and included in said respective actuation system.

4. Device according to claim 3, further comprising pulley-like supports (20) keyed to said interior shaft (16), for winding cords (21) for adjusting inclination of the slats of said Venetian blind.

5. Device according to claim 4, wherein said interior shaft (16) is indirectly connected to said pulley-like supports (20) for winding cords for packing said Venetian blind.

6. Device according to claim 4, further comprising a gearing-up unit interposed between said interior shaft (16) and said pulley-like supports (20).

7. In combination, an insulating glass frame (13), a Venetian blind (10) placed inside said insulating glass frame (13), a motorized actuation device for said Venetian blind (10), a venetian blind actuation system (16, 18, 20, 21), a first magnet (19) arranged inside said insulating glass frame and directly connected to said Venetian blind actuation system (16,18,20,21), a second external magnet (27), a kinematic system (23) for converting rotary motion into translatory motion, and an actuation gearmotor (25), said kinematic system (23) being connected to said actuation gearmotor (25);

wherein said gearmotor (25) has an output shaft, and wherein said kinematic system (23) comprises a worm screw (24) and a nut (26), said worm screw (24) being rigidly coupled to said output shaft of said electric gearmotor (25), said nut (26) threadedly engaging said worm screw and being retained slideably with respect to said insulating glass frame (13) said second external magnet being connected to said nut (26).

8. Combination according to claim 7, wherein said kinematic system (23) is contained within a box-like structure (22), said box-like structure (22) being removably fixed to said insulating glass frame (13).

9. Combination according to claim 7, wherein said actuation system (16,18,20,21) further comprises an interior shaft (16) having a portion defining an external helical profile (16), and a bush (18) defining an internal helical profile, said first magnet (19) being slidingly coupled to said insulating glass frame (13) and externally fixed to said bush (18), said interior shaft (16) being arranged inside said insulating glass frame (13), said internal helical profile defined by said bush (18) being shaped complementarily to said external helical profile (17) defined by said portion of said interior shaft (16).

10. Combination according to claim 9, further comprising cords (21) for adjusting inclination of slats of said Venetian blind, and wherein said actuation system (16,18,20,21) comprises pulley-like supports (20) for winding said cords (21), said pulley-like supports (20) being keyed to said interior shaft (16).

11. Combination according to claim 9, wherein said interior shaft (16) is indirectly connected to said pulley-like supports (20) for winding said cords (21) for adjusting said Venetian blind (10).

12. Combination according to claim 11, further comprising a gearing-up unit interposed between said interior shaft (16) and said pulley-like supports (20).

* * * * *